US011619906B2

(12) United States Patent
Yang et al.

(10) Patent No.: US 11,619,906 B2
(45) Date of Patent: Apr. 4, 2023

(54) PROCESSING CARTRIDGE AND ELECTRONIC IMAGING DEVICE

(71) Applicant: PRINT-RITE—UNICORN IMAGE PRODUCTS CO., LTD. OF ZHUHAI, Zhuhai (CN)

(72) Inventors: Xiaofeng Yang, Zhuhai (CN); Xinhua Yi, Zhuhai (CN); Leungmui Ho, Zhuhai (CN); Yuxia Zheng, Zhuhai (CN); Kinkeung So, Zhuhai (CN)

(73) Assignee: PRINT-RITE • UNICORN IMAGE PRODUCTS CO., LTD. OF ZHUHAI

( * ) Notice: Subject to any disclaimer, the term of this patent is extended or adjusted under 35 U.S.C. 154(b) by 0 days.

(21) Appl. No.: 17/569,705

(22) Filed: Jan. 6, 2022

(65) Prior Publication Data

US 2022/0404761 A1 Dec. 22, 2022

(30) Foreign Application Priority Data

Jun. 16, 2021 (CN) ..... 202110667903.5
Dec. 10, 2021 (CN) ..... 202111510087.3

(51) Int. Cl.
*G03G 21/18* (2006.01)
*G03G 21/00* (2006.01)
(Continued)

(52) U.S. Cl.
CPC ..... *G03G 21/1814* (2013.01); *G03G 15/0225* (2013.01); *G03G 15/0808* (2013.01);
(Continued)

(58) Field of Classification Search
CPC ..... G03G 15/0216; G03G 15/0225; G03G 15/0258; G03G 15/0808; G03G 21/0064; G03G 21/007; G03G 21/1633; G03G 21/1814; G03G 2221/1606; G03G 2221/183
See application file for complete search history.

(56) References Cited

U.S. PATENT DOCUMENTS 10,802,414 B1 * 10/2020 Kinuta ..... G03G 15/0258
2007/0183815 A1 * 8/2007 Himes ..... G03G 15/0875 399/262

(Continued)

*Primary Examiner* — Sophia S Chen
(74) *Attorney, Agent, or Firm* — Lerner, David, Littenberg, Krumholz & Mentlik, LLP

(57) ABSTRACT

The present invention provides a process cartridge and an electronic imaging device. The process cartridge includes a cartridge body having an accommodating cavity; a developing roller rotatably installed in the accommodating cavity; a photosensitive drum rotatably installed in the cartridge body; a charging roller that is in contact with a peripheral surface of the photosensitive drum and is spaced from the developing roller; and a cleaning member that is located in the accommodating cavity and installed in the cartridge body, extends in a direction parallel to the charging roller, and is in contact with a peripheral surface of the charging roller. The developing roller is in contact with the peripheral surface of the photosensitive drum. The electronic imaging device includes a machine body, and the foregoing process cartridge is detachably installed thereon. The present invention can increase the utilization rate of toner and reduce abrasion of the photosensitive drum.

18 Claims, 4 Drawing Sheets

(51) Int. Cl.

| | |
|---|---|
| ***G03G 15/02*** | (2006.01) |
| ***G03G 15/08*** | (2006.01) |
| ***G03G 21/16*** | (2006.01) |

(52) U.S. Cl.
CPC ..... *G03G 21/007* (2013.01); *G03G 21/1633* (2013.01); *G03G 2221/1606* (2013.01)

(56) References Cited

U.S. PATENT DOCUMENTS

| | | | | |
|---|---|---|---|---|
| 2007/0258727 | A1* | 11/2007 | Shinoda | G03G 21/1832 399/106 |
| 2015/0234348 | A1* | 8/2015 | Fujita | G03G 15/0225 399/100 |
| 2019/0041776 | A1* | 2/2019 | Oshima | G03G 15/0225 |
| 2019/0265625 | A1* | 8/2019 | Okubo | G03G 21/0064 |
| 2020/0150579 | A1* | 5/2020 | Baba | G03G 15/751 |

* cited by examiner

PROCESSING CARTRIDGE AND ELECTRONIC IMAGING DEVICE

CROSS REFERENCE TO RELATED APPLICATION

This patent application claims the benefit and priority of Chinese Patent Application No. 202110667903.5 filed on Jun. 16, 2021 and Chinese Patent Application No. 202111510087.3 filed on Dec. 10, 2021, the disclosure of which is incorporated by reference herein in its entirety as part of the present application.

TECHNICAL FIELD

The present invention relates to the field of electronic imaging devices, and in particular, to a process cartridge and an electronic imaging device with such a process cartridge.

BACKGROUND

An electrophotographic image forming device, such as a laser printer, is a device that uses the principle of electrophotography to undergo at least processes of charging, exposure, developing, transferring, fixing, and cleaning to form an image on an image forming medium (such as paper). An apparatus used in an imaging device and for printing materials consumed is generally referred to as a process cartridge or a printing consumable.

Toner usually consumed by development is generally provided by a process cartridge. When the toner in the process cartridge is used up, the process cartridge is replaced with a new one. An existing process cartridge includes a toner bin, a stirring frame, an upper frame, a cleaning scraper, and a photosensitive drum, where the stirring frame is rotatably installed in the toner bin, and the cleaning scraper and the upper frame enclose to form a waste toner accommodating cavity. Toner remaining on the photosensitive drum is cleaned out to the waste toner accommodating cavity by contacting the scraper on the process cartridge with the photosensitive drum. This requires the process cartridge to be provided with a space for storing waste toner, that is, the waste toner accommodating cavity. In addition, long-term friction between the scraper and the rotating photosensitive drum during operation damages a photosensitive coating on a surface of the photosensitive drum, and affects the exposure of the photosensitive drum and charging and charge eliminating effects of a charging roller on the photosensitive drum, which will further lead to more waste toner in printing. In addition, the waste toner accumulated on the photosensitive drum is easily bonded to the charging roller, causing the charging roller to be contaminated, thereby affecting charging and charge eliminating effects of the charging roller. Therefore, the scraper and waste toner have a great influence on print quality.

To expand the yield of printed pages of a product, another existing process cartridge is provided with a toner replenishing bin to increase the toner storage capacity of the process cartridge. However, the process cartridge generates more waste toner in the operating process. Because of the limited capacity of the waste toner bin, the small-capacity waste toner bin cannot accommodate the amount of waste toner generated by the large-capacity toner bin under the same number of printed pages. Therefore, after the waste toner in the waste toner bin reaches a certain amount, printing cannot continue, and excessive waste toner in the waste toner bin causes internal agglomeration of the waste toner.

After the foregoing two kinds of process cartridges are installed on a laser printer, the waste toner bin is located close to a fuser, and the temperature of the waste toner bin may be as high as 50° C. or more during operation, which makes the toner in the waste toner bin easily agglomerate.

Still another existing process cartridge is internally provided with a photosensitive drum, a charging roller, and a developing roller, where the charging roller is in contact with the photosensitive drum, and one side of the charging roller is provided with a cleaning brush for cleaning out waste toner remaining on the charging roller. The process cartridge is not provided with a cleaning scraper for cleaning toner remaining on the surface of the photosensitive drum. After being transferred to the charging roller, the toner remaining on the photosensitive drum is cleaned out by the cleaning brush, and then returned to a developing bin by using the photosensitive drum for reuse.

However, the process cartridge is usually suitable for leaping development, that is, the photosensitive drum is not in direct contact with the developing roller, that is, a gap is provided between the photosensitive drum and the developing roller, and the toner often jumps back and forth between the photosensitive drum and the developing roller. Thus, it is difficult to transfer the toner between the photosensitive drum and the developing roller, resulting in a large amount of toner remaining on the photosensitive drum. However, because the process cartridge is not provided with the cleaning scraper, the toner remaining on the photosensitive drum cannot be effectively transferred to the charging roller, and the toner remaining on the photosensitive drum will be transferred to paper in the next development cycle, thereby affecting print quality.

SUMMARY

A first objective of the present invention is to provide a process cartridge with a prolonged service life, enlarged capacity, and high print quality.

A second objective of the present invention is to provide an electronic imaging device with the foregoing process cartridge.

To achieve the first objective, a process cartridge provided in the present invention includes a cartridge body having an accommodating cavity; a developing roller rotatably installed in the accommodating cavity; a photosensitive drum rotatably installed in the cartridge body; a charging roller that is in contact with a peripheral surface of the photosensitive drum and is spaced from the developing roller; and a cleaning member that is located in the accommodating cavity and installed in the cartridge body, extends in a direction parallel to the charging roller, and is in contact with a peripheral surface of the charging roller. In addition, the developing roller is in contact with the peripheral surface of the photosensitive drum.

It may be learned from the foregoing solution that at a position in which the photosensitive drum is in contact with the charging roller, toner can be effectively transferred from a non-exposed area of the photosensitive drum to the developing roller by using a voltage difference between the charging roller and the developing roller, and toner on the developing roller is transferred to an exposed area of the photosensitive drum. This enables the residual toner in the non-exposed area of the photosensitive drum to be effectively transferred to the developing roller, and the toner is transferred by using the electric field, which prevents the residual toner on the photosensitive drum from affecting a next printing operation, thereby improving print quality.

In a preferred solution, the cartridge body is further provided with an opening and a laser channel, the opening communicates with the accommodating cavity, and the opening and the laser channel are oppositely arranged in a width direction of the cartridge body.

Therefore, it may be learned that the cleaning member is arranged to clean the charging roller, so that waste toner cleaned out by the cleaning member is transferred to the photosensitive drum first and then transferred to the developing roller under the action of electric field force, and then enters the developing chamber with the rotation of the developing roller, thereby implementing the reuse of the waste toner and increasing the utilization rate of the toner.

In addition, the charging roller can be cleaned through the arrangement of the cleaning member, so that a cleaning scraper is omitted, thereby preventing the damage to a photosensitive coating on a surface of photosensitive drum surface caused by the scraper, reducing a product cost and prolonging the service life of the product.

Furthermore, because the process cartridge does not need to collect waste toner, a waste toner accommodating cavity can be omitted, and the capacity of the toner bin is increased, thereby expanding the capacity of the process cartridge, increasing the yield of printed pages, and improving the product cost performance.

In addition, because no waste toner accommodating cavity is provided, the original location of the waste toner accommodating cavity no longer needs to be filled with toner, thereby solving the problem in the prior art that the waste toner accommodating cavity is excessively close to a fuser, making the toner in a waste toner bin easily agglomerated.

In a preferred solution, the cleaning member is a cleaning brush, or the cleaning member is made of a sponge or a foamed cotton material.

It can be learned that the cleaning member has certain flexibility, and can better clean the charging roller.

In a preferred solution, the cleaning member is made of a conductive material; an axial end of the charging roller is provided with a charging roller electrode, and both the cleaning member and the charging roller are electrically connected to the charging roller electrode.

It can be learned that the cleaning member can conduct electricity, which can change electrical properties of the toner. For example, when the photosensitive drum is exposed and developed, the toner on the surface is usually negatively charged, but electrical properties may be changed in the operating process, so that the toner becomes positively charged. If this situation is not treated, after the waste toner enters the developing chamber, the toner in the developing chamber will agglomerate and affect printing due to the attraction between positive and negative charges. In the present invention, the cleaning member with conductive performance is energized, so that the cleaning member neutralizes the positive charge carried by the toner and carries the negative charge to the toner, so as to ensure that the charge carried by the waste toner is consistent with the charge carried by the toner in the developing chamber, prevent the toner from agglomerating, and ensure printing effects.

In a preferred solution, the cartridge body is provided with a supporting wall, and the cleaning member is installed on the supporting wall; or a supporting rod is installed on the cartridge body, a fixed end of the supporting rod is connected to the cartridge body, and the cleaning member is installed at a free end of the supporting rod.

It can be learned that the position of the cleaning member can be flexibly adjusted according to the position of the photosensitive drum to ensure the charging effect and the cleaning effect.

In a preferred solution, the cleaning member is fixed to the cartridge body, a side wall of the cleaning member facing the charging roller is arc-shaped, and the arc-shaped side wall bends in a direction away from the charging roller.

It can be learned that the cleaning member wraps a part of the charging roller, so that a contact area between the cleaning member and the charging roller is larger, and the charging roller is cleaned well during the rotation of the charging roller.

In a preferred solution, the cleaning member is cylindrical and rotatably mounted on the cartridge body.

It can be learned that the cleaning member is in rotatable contact with the charging roller, so that rolling friction is formed between the two, the friction is small, and the contact area between the cleaning member and the charging roller can be greater, making the cleaning effect better.

In a preferred solution, an upper edge of the opening is provided with a sealing member, the sealing member extends in a length direction of the photosensitive drum, a fixed end of the sealing member is fixedly connected to the cartridge body, and a free end of the sealing member abuts against the peripheral surface of the photosensitive drum; and only the charging roller, the developing roller and the sealing member are in contact with the peripheral surface of the photosensitive drum.

It can be learned that only the charging roller, the developing roller and the sealing member are in contact with the peripheral surface of the photosensitive drum, and no scraper is in contact with the surface of the photosensitive drum, which reduces the product cost and prolongs the service life of the product.

In a preferred solution, in the width direction of the cartridge body, the developing roller and the charging roller are both located on one side of the photosensitive drum close to the laser channel; the developing roller is located below the charging roller, a laser passing area is formed between the charging roller and the developing roller, and projections of the laser channel, the laser passing area and the photosensitive drum in the width direction of the cartridge body overlap.

It can be learned that laser light is irradiated to the photosensitive drum after passing through the laser channel and the laser passing area.

In a preferred solution, the accommodating cavity includes a toner accommodating cavity and a developing chamber that communicate with each other and are arranged in the width direction of the cartridge body, and the laser channel is located above the toner accommodating cavity.

It can be learned that the toner accommodating cavity is configured to supply toner into the developing chamber.

In a further solution, the cartridge body includes a toner bin frame, a first cover component, and a second cover component, the toner bin frame is internally provided with a partition wall, and the partition wall is provided with a communication port; the first cover component and the toner bin frame enclose to form the accommodating cavity, the second cover component and the toner bin frame enclose to form the toner accommodating cavity, the developing chamber and the toner accommodating chamber are arranged in the width direction of the cartridge body, and the developing chamber and the toner accommodating cavity are separated by the partition wall and communicate by using the communication port; the first cover component is located above the second cover component, and the laser channel is located between the first cover component and the second cover component.

It can be learned that, because in the present invention, the waste toner accommodating cavity does not need to be provided, the space for accommodating the toner inside the cartridge body is larger, and the capacity of the toner bin increases.

In a further solution, the cartridge body further includes a toner replenishing bin, where the toner replenishing bin is located above the toner accommodating cavity and communicates with the toner accommodating cavity, and the laser channel is located between the toner replenishing bin and the toner accommodating cavity.

It can be learned that through the additional arrangement of the toner replenishing bin, the capacity of the toner in the cartridge body can be further increased, thereby expanding the capacity of the process cartridge, increasing the yield of printed pages of the product, and improving the product cost performance. In addition, the process cartridge according to the present invention does not produce waste toner, thereby solving the problem that the toner replenishing bin increases the capacity of the process cartridge, so that the small-capacity waste toner bin cannot accommodate the amount of waste toner generated by the large-capacity toner bin under the same number of printed pages, and printing cannot be continued.

In a further solution, the cartridge body includes a toner bin frame, a first cover component, a second cover component, a toner replenishing bin frame, and a third cover component, where the toner bin frame is internally provided with a partition wall, and the partition wall is provided with a communication port; the first cover component and the toner bin frame enclose to form the accommodating cavity, the second cover component and the toner bin frame enclose to form the toner accommodating cavity, the developing chamber and the toner accommodating chamber are arranged in the width direction of the cartridge body, and the developing chamber and the toner accommodating cavity are separated by the partition wall and communicate by using the communication port; the toner replenishing bin frame is connected above the second cover component, the toner replenishing bin frame and the third cover component enclose to form the toner replenishing bin, and the first cover component and the third cover component are arranged in the width direction of the cartridge body.

It can be learned that in the prior art, because the laser channel separates the first cover component from the toner accommodating cavity, a part of the first cover component located on an upper side of the toner accommodating cavity is not fully utilized, so that the capacity of the process cartridge is relatively smaller. In this solution, the part of the first cover component located on the upper side of the toner accommodating cavity is removed, and the toner replenishing bin is installed on the upper side of the toner accommodating cavity, so that the accommodating space of a printer is reasonably and effectively used, thereby increasing the capacity of the process cartridge, giving full play to maximum benefits of the printer and the process cartridge, and saving social resources.

In a still further solution, an end wall of the cartridge body is provided with a toner adding port, and the toner adding port is provided with a sealing end cover.

The end wall of the cartridge body is provided with the toner adding port, so that it is convenient for a user to add toner by himself/herself, which facilitates the user's toner adding operation.

Another process cartridge according to the present invention includes a cartridge body having an accommodating cavity; a developing roller rotatably installed in the accommodating cavity; a photosensitive drum rotatably installed in the cartridge body; and a charging roller that is in contact with a peripheral surface of the photosensitive drum, and is spaced from the developing roller, where the developing roller is in contact with the peripheral surface of the photosensitive drum. In addition, an absolute value of a charging voltage obtained by the charging roller is greater than an absolute value of a developing bias voltage obtained by the developing roller, and an absolute value of a voltage in an exposed area of the photosensitive drum is less than the absolute value of the developing bias voltage.

It can be learned that because the absolute value of the charging voltage applied by the charging roller to the surface of the photosensitive drum is higher, and the absolute value of the voltage in the exposed area is lower, the charge carried by the toner is less, that is, the absolute value of the voltage of the toner is very small or even close to electrical neutrality, and the absolute value of the voltage in the exposed area of the photosensitive drum is less than the absolute value of the developing bias voltage. Therefore, in the contact area between the photosensitive drum and the developing roller, a larger potential difference is formed between the exposed area of the photosensitive drum and the developing roller, a larger potential difference is also formed between the non-exposed area of the photosensitive drum and the developing roller, and the toner is transferred under the action of the electric field force. Specifically, toner is transferred from the surface of the non-exposed area of the photosensitive drum to the developing roller, and toner on the developing roller is transferred to the exposed area. In this way, the toner is transferred through the action of the electric field force, so as to prevent excessive toner from remaining on the non-exposed area of the photosensitive drum and affecting print quality.

In a further solution, the charging voltage, the developing bias voltage, and the voltage of the exposed area are all positive voltages, or the charging voltage, the developing bias voltage, and the voltage of the exposed area are all negative voltages.

In a further solution, the cartridge body is internally further provided with a cleaning member, and the cleaning member is located in the accommodating cavity and installed in the cartridge body, extends in a direction parallel to the charging roller, and is in contact with a peripheral surface of the charging roller.

In a further solution, the cleaning member is made of a conductive material; an axial end of the charging roller is provided with a charging roller electrode, and both the cleaning member and the charging roller are electrically connected to the charging roller electrode.

Still another process cartridge according to the present invention includes a cartridge body having an accommodating cavity; a developing roller rotatably installed in the accommodating cavity; a photosensitive drum rotatably installed in the cartridge body; and a charging roller that is in contact with a peripheral surface of the photosensitive drum, and is spaced from the developing roller. In addition, the developing roller is in contact with the peripheral surface of the photosensitive drum. At a position in which the photosensitive drum is in contact with the charging roller, the charging roller applies a voltage to the photosensitive drum with residual toner; when the photosensitive drum is exposed, an absolute value of a voltage formed in an exposed area is less than an absolute value of a charging voltage, a voltage is applied to the developing roller, an electric field is formed between the developing roller and the photosensitive drum, residual toner in a non-exposed area of the photosensitive drum is transferred from the photosensitive drum to the developing roller, and toner on the developing roller is transferred to the exposed area of the photosensitive drum.

To achieve the second objective, an electronic imaging device according to the present invention includes a machine body, where a process cartridge mounting cavity is disposed in the machine body, and the foregoing process cartridge is detachably mounted in the process cartridge mounting cavity.

The present invention is further described below with reference to drawings and embodiments.

DESCRIPTION OF EMBODIMENTS

Figure 1:
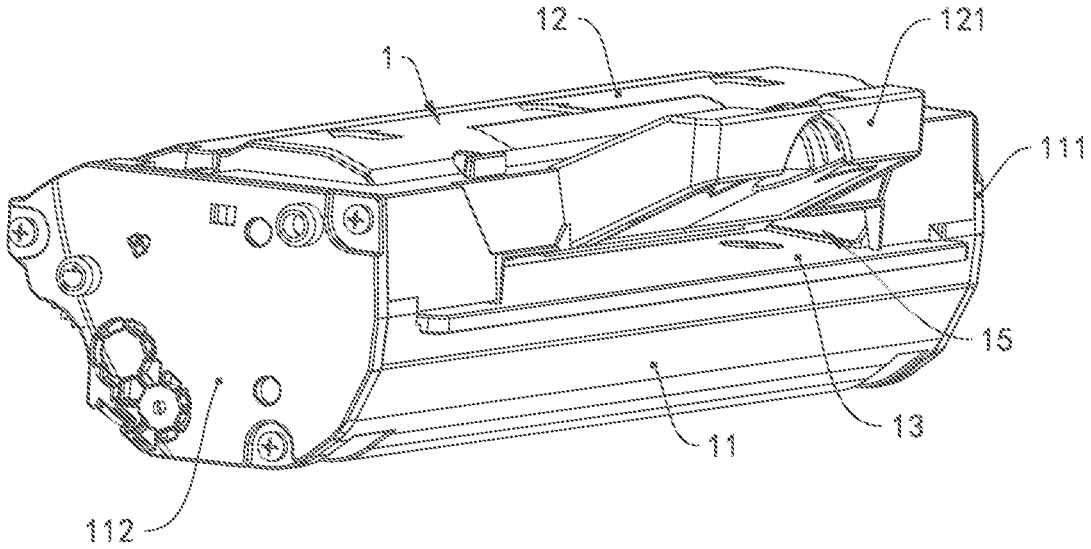
FIG. 1 is a structural diagram of a first embodiment of a process cartridge according to the present invention.
Figure 2:
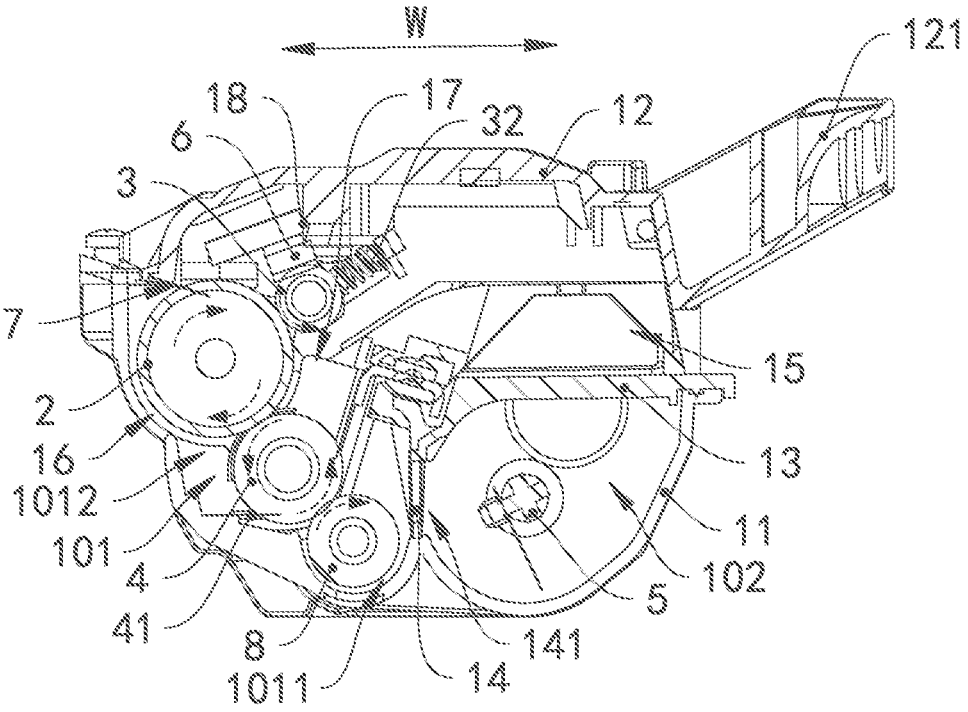
FIG. 2 is a sectional view of the first embodiment of a process cartridge according to the present invention.
Figure 3:
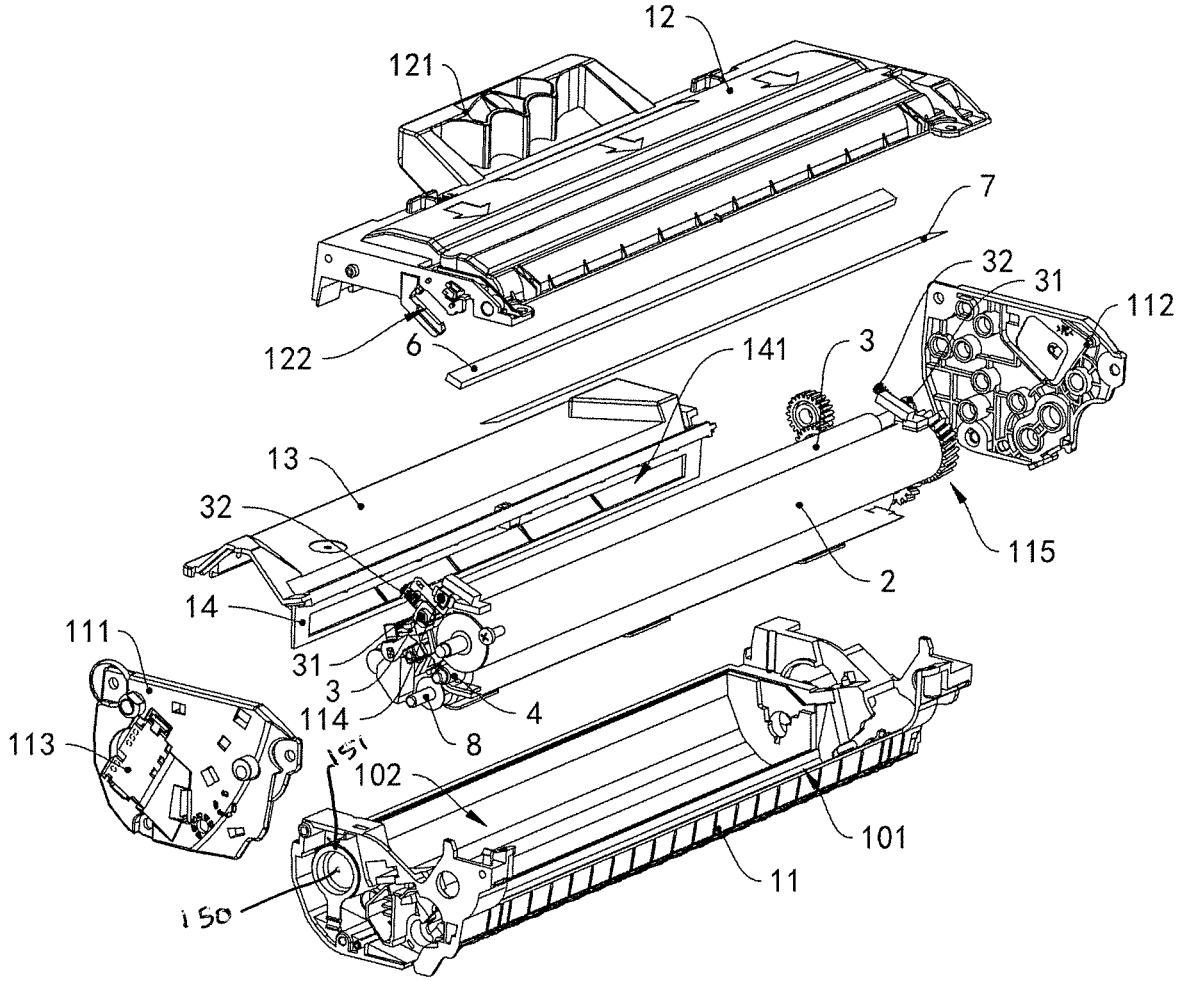
FIG. 3 is a structural exploded view of the first embodiment of a process cartridge according to the present invention.
Figure 4:
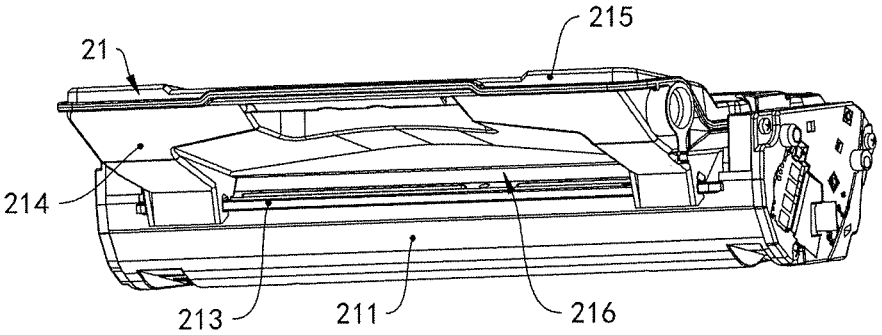
FIG. 4 is a structural diagram of a second embodiment of a process cartridge according to the present invention.
Figure 5:
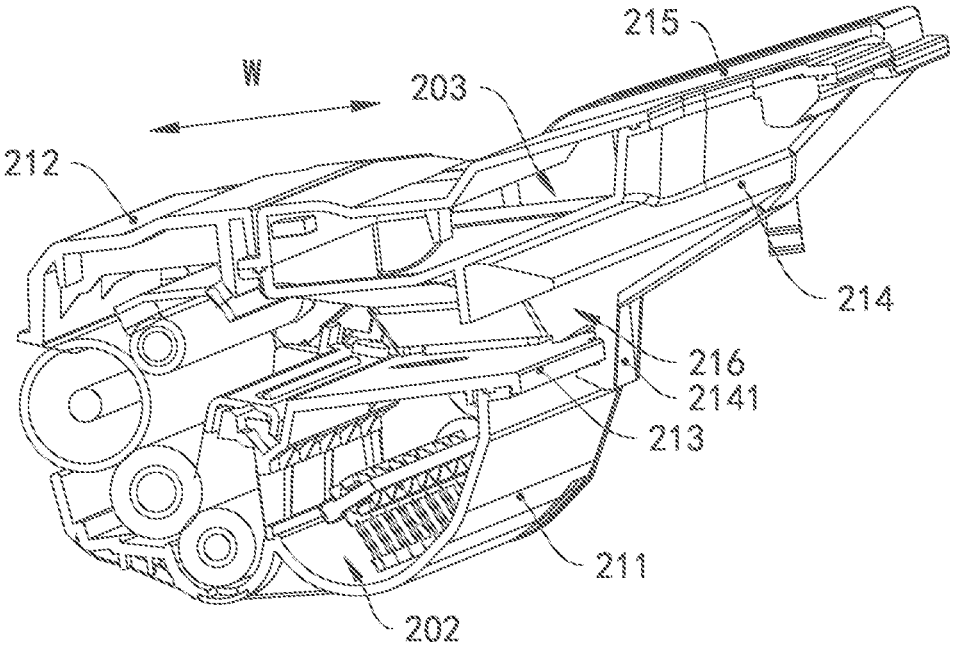
FIG. 5 is a sectional view of the second embodiment of a process cartridge according to the present invention.
Figure 6:
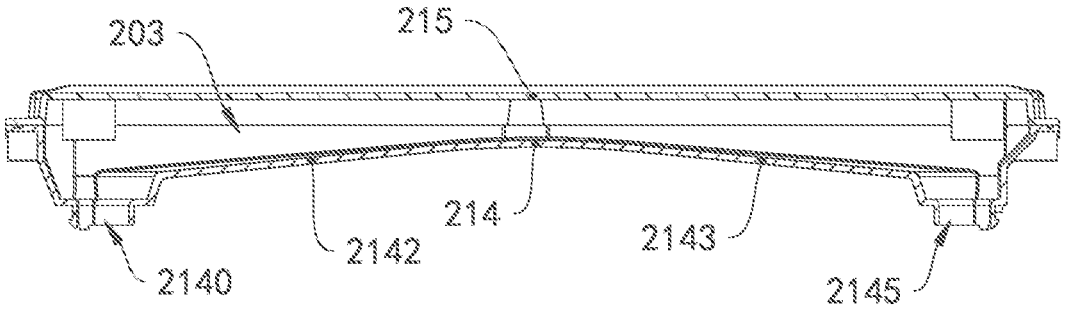
FIG. 6 is a sectional view of a toner replenishing bin frame and a third cover component in the second embodiment of a process cartridge according to the present invention.
Figure 7:
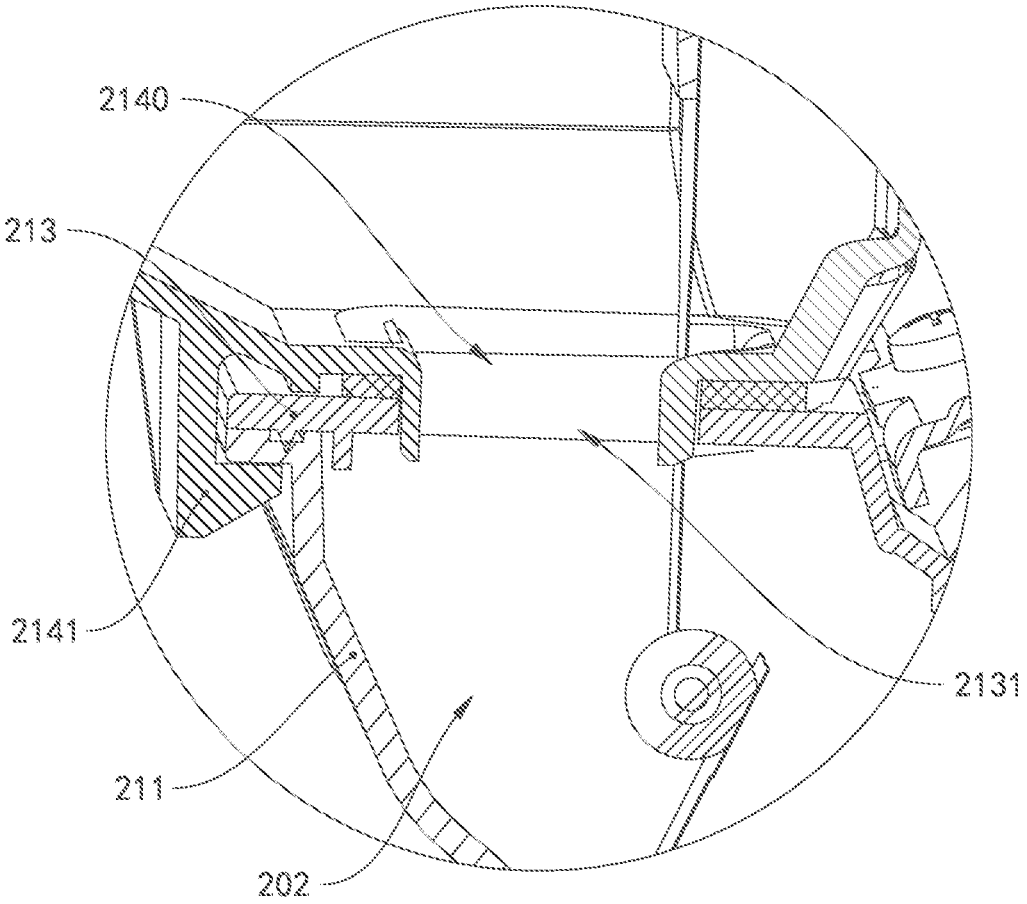
FIG. 7 is a partial enlarged view of a toner replenishing port in the second embodiment of a process cartridge according to the present invention.

First Embodiment of a Process Cartridge:

Referring to FIG. 1 to FIG. 3, the process cartridge in this embodiment includes a cartridge body 1, a photosensitive drum 2, a charging roller 3, a developing roller 4, a toner feeding roller 8, a stirring frame 5, a cleaning member 6, and a toner discharging scraper 9. The cleaning member 6 is a cleaning brush.

The cartridge body 1 includes a toner bin frame 11, a first cover component 12, a second cover component 13, a conductive end cover 111, and a driving end cover 112. The first cover component 12 and the toner bin frame 11 enclose to form an accommodating cavity 101, and the second cover component 13 and the toner bin frame 11 enclose to form a toner accommodating cavity 102. The toner bin frame 11 is internally provided with a partition wall 14, the partition wall 14 and the second cover component 13 are integrally formed, and the partition wall 14 is provided with a communication port 141. The accommodating cavity 101 and the toner accommodating cavity 102 are separated by using the partition wall 14 and communicate with each other by using the communication port 141.

An opening 16 is formed between the first cover component 12 and the toner bin frame 11, and the opening 16 communicates with the accommodating cavity 101. The opening 16 and a laser channel 15 are oppositely arranged in a width direction W of the cartridge body 1, and the photosensitive drum 2 is rotatably installed at the opening 16.

The conductive end cover 111 and the driving end cover 112 are arranged at two ends of a length direction of the cartridge body 1 respectively, and the conductive end cover 111 is provided with a chip 113 and a charging roller electrode 114. The charging roller electrode 114 is electrically connected to an end of the charging roller 3. The first cover component 12 is located above the second cover component 13, and the laser channel 15 is arranged between the first cover component 12 and the second cover component 13. Laser light is irradiated onto the photosensitive drum 2 through the laser channel 15. A handle 121 is provided in a middle portion of the length direction of the first cover component 12. The handle 121 is located on one side of the first cover component 12 away from the photosensitive drum 2. The handle 121 enables a user to conveniently install the process cartridge in a printer or remove the process cartridge from the printer.

The accommodating cavity 101 includes a first chamber 1011 and a second chamber 1012, and the first chamber 1011 is connected between the second chamber 1012 and the toner accommodating cavity 102. The first chamber 1011 is a developing chamber, and the toner feeding roller 8 is located inside the first chamber 1011. A fixed end of the toner discharging scraper 9 is installed on the second cover component 13, and a free end of the toner discharging scraper 9 abuts against a peripheral surface of the developing roller 4. A sealing blade 41 is arranged on one side of the developing roller 4 opposite to the toner discharging scraper 9. A fixed end of the sealing blade 41 is fixedly connected to the toner bin frame 11, and a free end of the sealing blade 41 abuts against the peripheral surface of the developing roller 4. The toner discharging scraper 9, the developing roller 4 and the sealing blade 41 match to separate the first chamber 1011 from the second chamber 1012. The photosensitive drum 2, the charging roller 3 and the cleaning member 6 are all arranged in parallel and located in the second chamber 1012. Two ends of each of the photosensitive drum 2, the developing roller 4 and the toner feeding roller 8 are rotatably supported on two end walls of the toner bin frame 11, and a gear train 115 is installed on the end wall of one end of the cartridge body 1 near the driving end cover 112. The gear train 115 drives the photosensitive drum 2, the developing roller 4, the toner feeding roller 8, the stirring frame 5 and the like to rotate. The stirring frame 5 is installed in the toner accommodating chamber 102, and is configured to convey the toner in the toner accommodating cavity 102 to the inside of the developing chamber 1011.

The charging roller 3 and the developing roller 4 are in contact with a peripheral surface of the photosensitive drum 2, and the charging roller 3 is spaced from the developing roller 4. Two ends of the charging roller 3 are each provided with a support 31 and a spring 32. The end of the charging roller 3 is mounted on the support 31, and the spring 32 abuts against the support 31 in a radial direction of the charging roller 3. Two ends of the first cover component 12 are each provided with a guide chute 122, and the support 31 and the spring 32 are installed in the guide chute 122. The support 31 is in sliding fit with the guide chute 122, and elastic restoring force of the spring 32 forces the charging roller 3 to approach and abut against the photosensitive drum 2. The support 31 is made of a conductive material, and the charging roller electrode 114 is connected to the spring 32.

In the width direction W of the cartridge body 1, the developing roller 4 and the charging roller 3 are both located on one side of the photosensitive drum 2 close to the laser channel 15. The developing roller 4 is located below the charging roller 3, a laser passing area 17 is formed between the charging roller 3 and the developing roller 4, and projections of the laser channel 15, the laser passing area 17 and the photosensitive drum 2 in the width direction W of the cartridge body 1 overlap.

An inner wall of the accommodating cavity 101 is provided with a supporting wall 18, and the cleaning member 6 is in a long strip shape, is fixed to the supporting wall 18 and abuts against a circumferential surface of the charging roller 3. Preferably, a side wall of the cleaning member 6 facing the charging roller 3 is in an arc shape, and the arc-shaped side wall bends in a direction away from the charging roller 3 and closely adheres to a peripheral surface of the charging roller 3.

An upper edge of the opening 16 is provided with a sealing member 7, the sealing member 7 extends in a length direction of the photosensitive drum 2, a fixed end of the sealing member 7 is fixedly connected to the cartridge body 1, and a free end of the sealing member 7 abuts against the peripheral surface of the photosensitive drum 2. Only the charging roller 3, the developing roller 4 and the sealing member 7 are in contact with the peripheral surface of the photosensitive drum 2, and no scraper is in contact with the surface of the photosensitive drum 2.

In addition, an end wall of the cartridge body 1 is provided with a toner adding port 151, and a sealing end cover 150 is arranged at the toner adding port 151. In this way, after the toner in the process cartridge is used up, the user can remove the sealing end cover 150 by himself/herself and fill the process cartridge with toner by using the toner adding port 151. After the toner is added, the process cartridge can continue to be used.

In this embodiment, an absolute value of a charging voltage applied to the charging roller 3 by a laser printer is greater than an absolute value of a developing bias voltage applied to the developing roller 4, and when the photosensitive drum 2 is exposed, an absolute value of a voltage in an exposed area of the photosensitive drum 2 is less than the absolute value of the developing bias voltage. For example, a charging voltage applied by the laser printer to the charging roller 3 is −500 V, the voltage in the exposed area of the photosensitive drum 2 is −100 V, and the developing bias voltage is −300 V. The toner has a small amount of charge. Generally, the voltage polarity of the toner is the same as that of the charging roller and that of the developing roller, for example, the voltages are negative voltages or are electrically neutral. After the end of one development cycle and at the beginning of the next development cycle, the charging roller 3 charges the photosensitive drum 2 first, that is, at a downstream end at which the charging roller 3 is in contact with the photosensitive drum 2, the voltage on the surface of the photosensitive drum 2 is about −500 V, and the voltage of the toner remaining on the surface of the photosensitive drum 2 is also approximately −500 V. The upstream and downstream of this embodiment are described in terms of the rotation direction of the photosensitive drum 2 in one printing cycle. Specifically, in one printing cycle, the photosensitive drum 2 is in contact with the charging roller 3 first, so that the charging roller 3 applies a voltage to the photosensitive drum 2, and then the photosensitive drum 2 is irradiated by a laser beam to implement exposure. Then the photosensitive drum 2 is in contact with the developing roller 4 and is loaded with a developing bias voltage. Therefore, the downstream end at which the photosensitive drum 2 is in contact with the charging roller 3 is an area prior to exposure after the photosensitive drum 2 is in contact with the charging roller 3.

As the photosensitive drum 2 rotates, during exposure, an area of the photosensitive drum 2 irradiated by the laser beam is an exposed area. After exposure, the voltage in the exposed area of the photosensitive drum 2 is −100 V, and the non-exposed area is not irradiated by the laser beam and the voltage is still −500 V. Therefore, the voltage of the toner in the exposed area is also about −100 V, and the voltage of the toner in the non-exposed area is about −500 V.

As the photosensitive drum 2 continues to rotate, in the contact area between the photosensitive drum 2 and the developing roller 4, the developing bias voltage of the developing roller 4 is −300 V, and the voltage of the toner on the developing roller 4 is also about −300 V, which is higher than that of the exposed area of the photosensitive drum 2, but less than that of the non-exposed area of the photosensitive drum 2. Because the toner has a small amount of negative charge, under the action of the electric field force, the toner on the non-exposed area of the photosensitive drum 2 is transferred to the developing roller 4, and the toner on the developing roller 4 will be transferred to the exposed area of the photosensitive drum 2. In this way, an electric field area is formed in the contract area between the photosensitive drum 2 and the developing roller 4. In the electric field area, a relatively large electric field force is formed between the photosensitive drum 2 and the developing roller 4. The toner is transferred between the photosensitive drum 2 and the developing roller 4 under the action of the electric field force, and very little toner remains on the non-exposed area of the photosensitive drum 2, thereby avoiding forming unnecessary text or patterns on paper after printing. In addition, the toner originally remaining on the photosensitive drum 2 will be reused for development, and therefore, the utilization rate of the toner can be increased.

In addition, because the photosensitive drum 2 is in direct contact with the developing roller 4, that is, no gap is provided between the photosensitive drum 2 and the charging roller 4, the rapid transfer of the toner between the photosensitive drum 2 and the developing roller 4 is facilitated, so that the toner in the non-exposed area of the photosensitive drum 2 can be fully transferred to the developing roller 4, thereby effectively recycling the toner, ensuring that the toner in the developing roller 4 can be fully transferred to the exposed area of the photosensitive drum 2, and ensuring print quality.

Certainly, if the charging voltage of the charging roller, the voltage in the exposed area of the photosensitive drum, and the developing bias voltage of the developing roller are all positive voltages, and the toner has a small amount of positive charge, because a potential difference exists between the exposed area of the photosensitive drum and the developing roller, and a potential difference also exists between the developing roller and the non-exposed area of the photosensitive drum, the toner can also be transferred under the action of the electric field force, so that very little toner remains on the non-exposed area of the photosensitive drum, which does not affect the print quality.

In addition, the waste toner on the photosensitive drum is transferred to the charging roller by friction through the arrangement of the cleaning member, and the cleaning member cleans the charging roller, so that a cleaning scraper may be omitted, thereby preventing the damage to a photosensitive coating on a surface of photosensitive drum surface caused by the scraper, reducing a product cost and prolonging the service life of the product. Furthermore, because the process cartridge does not need to collect waste toner, a waste toner accommodating cavity can be omitted, and the capacity of the toner bin is increased, thereby expanding the capacity of the process cartridge, increasing the yield of printed pages, and improving the product cost performance. In addition, because no waste toner accommodating cavity is provided, the original location of the waste toner accommodating cavity no longer needs to be filled with toner, thereby solving the problem in the prior art that the waste toner accommodating cavity is excessively close to a fuser, making the toner in a waste toner bin easily agglomerated.

Second Embodiment of a Process Cartridge:

As a description of the second embodiment of the process cartridge according to the present invention, the following describes only the differences from the first embodiment of the foregoing process cartridge.

Referring to FIG. 4 to FIG. 7, the cartridge body 21 further includes a toner replenishing bin frame 214 and a third cover component 215. The toner replenishing bin frame 214 is connected above a second cover component 213, and the toner replenishing bin frame 214 and the third cover component 215 enclose to form a toner replenishing bin 203. The toner replenishing bin 203 is located above a toner accommodating cavity 202 and communicates with the toner accommodating cavity 202, and a laser channel 216 is located between the second cover component 213 and the toner replenishing bin frame 214. A first cover component 212 and the third cover component 215 are arranged in a width direction W of the cartridge body 21.

The second cover component 213 is provided with two toner replenishing ports 2131, and the two toner replenishing ports 2131 are arranged close to two ends of the toner accommodating cavity 202 in the length direction respectively. The bottom of the toner replenishing bin frame 214 is provided with two supply ports 2140, and one supply port 2140 is in hermetical butt joint with one toner replenishing port 2131. The toner replenishing bin frame 214 is detachably fixedly connected to a toner bin frame 211 and the second cover component 213 by using buckles 2141. A bottom wall of the toner replenishing bin frame 214 includes a first inclined wall 2142 and a second inclined wall 2143. The first inclined wall 2142 and the second inclined wall 2143 are arranged in a length direction of the toner replenishing bin 203. One supply port 2140 is arranged at an end of the first inclined wall 2142 in the length direction, and the first inclined wall 2142 is inclined toward the supply port 2140. The other supply port 2145 is arranged at an end of the second inclined wall 2143 in the length direction, and the second inclined wall 2143 is inclined toward the supply port 2145. The arrangement of the first inclined wall 2142 and the second inclined wall 2143 enables the toner in the toner replenishing bin 203 to conveniently enter the toner accommodating cavity 202 from the supply port under the action of gravity. The first inclined wall 2142, the second inclined wall 2143 and the second cover component 213 enclose to form the laser channel 216.

It can be learned that in the prior art, because the laser channel separates an upper cover body from the toner accommodating cavity, a part of the upper cover body located on an upper side of the toner accommodating cavity is not fully utilized, so that the capacity of the process cartridge is relatively smaller. In this solution, the part of the upper cover body located on the upper side of the toner accommodating cavity is removed, and the toner replenishing bin is installed on the upper side of the toner accommodating cavity, so that the accommodating space of a printer is reasonably and effectively used, thereby increasing the capacity of the process cartridge, giving full play to maximum benefits of the printer and the process cartridge, and saving social resources.

Through the additional arrangement of the toner replenishing bin, the capacity of the toner in the cartridge body can be further increased, thereby expanding the capacity of the process cartridge, increasing the yield of printed pages of the product, and improving the product cost performance. In addition, the process cartridge according to the present invention can make full use of the toner, thereby solving the problem that the toner replenishing bin increases the capacity of the process cartridge, so that the small-capacity waste toner bin cannot accommodate the amount of waste toner generated by the large-capacity toner bin under the same number of printed pages, and printing cannot be continued.

Third Embodiment of a Process Cartridge:

As a description of the third embodiment of the process cartridge according to the present invention, the following describes only the differences from the first embodiment of the foregoing process cartridge.

In this embodiment, the cleaning brush is made of fibers with conductive carbon black. The cleaning member is electrically connected to the charging roller electrode.

The cleaning member can conduct electricity, which can change electrical properties of the toner. For example, when the photosensitive drum is exposed and developed, the toner on the surface of the photosensitive drum is usually negatively charged, but electrical properties may be changed in the operating process, so that the toner becomes positively charged. If this situation is not treated, after the waste toner enters the developing chamber, the toner in the developing chamber will agglomerate and affect printing due to the attraction between positive and negative charges. In the present invention, the cleaning member with conductive performance is energized, and the cleaning member performs secondary charging on the toner, so that the toner is negatively charged, so as to ensure that the charge carried by the waste toner is consistent with the charge carried by the toner in the developing chamber, prevent the toner from agglomerating, and ensure printing effects.

Fourth Embodiment of a Process Cartridge:

As a description of the fourth embodiment of the process cartridge according to the present invention, the following describes only the differences from the third embodiment of the foregoing process cartridge.

In this embodiment, the process cartridge further includes a cleaning support and a cleaning electrode. The cleaning electrode is arranged on a conductive end cover and electrically connected to the cleaning support. A cleaning member is installed at a free end of the cleaning support. The cleaning support can conduct electricity, and the cleaning member is electrically connected to the cleaning electrode.

The cleaning support is a scraper support on the existing process cartridge, and the cleaning electrode is a scraper electrode on the existing process cartridge. A blade of a scraper is omitted based on the existing process cartridge, and a cleaning brush is installed at the position in which the blade is installed. The existing scraper electrode is used to supply power to the cleaning member to implement the secondary charging of the toner by the cleaning member, so that the electrical properties of the toner are changed.

In addition, the cleaning member may alternatively be cylindrical and rotatably mounted on the cartridge body. The cleaning member may be directly installed on the cartridge body, or a supporting rod may be installed on the cartridge body. A fixed end of the supporting rod is connected to the cartridge body, and the cleaning member is installed at a free end of the supporting rod. The cleaning member may alternatively be made of a sponge, a foamed cotton material or a material with electric conductivity. A side wall of the cleaning member facing the charging roller may alternatively be planar, or may be arc-shaped and the radian is inconsistent with the radian of the peripheral surface of the charging roller, and the cleaning member abuts against the peripheral surface of the charging roller to increase friction and achieve a good cleaning effect. The first cover component and the third cover component may be two separate parts, or may be integrally formed. The foregoing changes can also achieve the objectives of the present invention.

Embodiment of an Electronic Imaging Device:

The electronic imaging device according to the present invention may be a laser printer. The laser printer includes a machine body, where a process cartridge mounting cavity is disposed in the machine body, and the process cartridge according to any one of the foregoing embodiments is detachably mounted in the process cartridge mounting cavity.

Finally, it should be noted that the above is only the preferred embodiments of the present invention, and is not intended to limit the present invention. For a person skilled in the art, various changes and modifications may be made to the present invention. Any modification, equivalent replacement, improvement and the like made within the spirit and principle of the present invention shall fall within the protection scope of the present invention.

What is claimed is:

1. A process cartridge, comprising:

a cartridge body having an accommodating cavity;

a developing roller rotatably installed in the accommodating cavity;

a photosensitive drum rotatably installed in the cartridge body;

a charging roller that is in contact with a peripheral surface of the photosensitive drum and is spaced from the developing roller; and a cleaning member that is located in the accommodating cavity and installed in the cartridge body, extends in a direction parallel to the charging roller, and is in contact with a peripheral surface of the charging roller, wherein the developing roller is in contact with the peripheral surface of the photosensitive drum;

wherein the cartridge body is further provided with an opening and a laser channel, the opening communicates with the accommodating cavity, and the opening and the laser channel are oppositely arranged in a width direction of the cartridge body; and the developing roller is located below the charging roller, a laser passing area is formed between the charging roller and the developing roller, and projections of the laser channel, the laser passing area and the photosensitive drum in the width direction of the cartridge body overlap.

2. The process cartridge according to claim 1, wherein the cleaning member is made of a conductive material; and an axial end of the charging roller is provided with a charging roller electrode, and both the cleaning member and the charging roller are electrically connected to the charging roller electrode.

3. The process cartridge according to claim 1, wherein the cartridge body is provided with a supporting wall, and the cleaning member is installed on the supporting wall.

4. The process cartridge according to claim 1, wherein the cleaning member is fixed to the cartridge body, a side wall of the cleaning member facing the charging roller is arc-shaped, and the arc-shaped side wall bends in a direction away from the charging roller.

5. The process cartridge according to claim 1, wherein an upper edge of the opening is provided with a sealing member, the sealing member extends in a length direction of the photosensitive drum, a fixed end of the sealing member is fixedly connected to the cartridge body, and a free end of the sealing member abuts against the peripheral surface of the photosensitive drum; and only the charging roller, the developing roller and the sealing member are in contact with the peripheral surface of the photosensitive drum.

6. The process cartridge according to claim 1, wherein in the width direction of the cartridge body, the developing roller and the charging roller are both located on one side of the photosensitive drum close to the laser channel.

7. The process cartridge according to claim 1, wherein the accommodating cavity comprises a toner accommodating cavity and a developing chamber that communicate with each other and are arranged in the width direction of the cartridge body, and the laser channel is located above the toner accommodating cavity.

8. The process cartridge according to claim 7, wherein the cartridge body comprises a toner bin frame, a first cover component, and a second cover component, the toner bin frame is internally provided with a partition wall, and the partition wall is provided with a communication port;

the first cover component and the toner bin frame enclose to form the accommodating cavity, the second cover component and the toner bin frame enclose to form the toner accommodating cavity, and the developing chamber and the toner accommodating cavity are separated by the partition wall and communicate by using the communication port; and the first cover component is located above the second cover component, and the laser channel is located between the first cover component and the second cover component.

9. The process cartridge according to claim 7, wherein the cartridge body further comprises a toner replenishing bin, the toner replenishing bin is located above the toner accommodating cavity and communicates with the toner accommodating cavity, and the laser channel is located between the toner replenishing bin and the toner accommodating cavity.

10. The process cartridge according to claim 9, wherein the cartridge body comprises a toner bin frame, a first cover component, a second cover component, a toner replenishing bin frame, and a third cover component;

the toner bin frame is internally provided with a partition wall, and the partition wall is provided with a communication port;

the first cover component and the toner bin frame enclose to form the accommodating cavity, the second cover component and the toner bin frame enclose to form the toner accommodating cavity, and the developing chamber and the toner accommodating cavity are separated by the partition wall and communicate by using the communication port; and the toner replenishing bin frame is connected above the second cover component, the toner replenishing bin frame and the third cover component enclose to form the toner replenishing bin, and the first cover component and the third cover component are arranged in the width direction of the cartridge body.

11. The process cartridge according to claim 1, wherein an end wall of the cartridge body is provided with a toner adding port, and the toner adding port is provided with a sealing end cover.

12. An electronic imaging device, comprising:

a machine body, wherein a process cartridge mounting cavity is disposed in the machine body, and the process cartridge according to claim 1 is detachably mounted in the process cartridge mounting cavity.

13. A process cartridge, comprising:

a cartridge body having an accommodating cavity;

a developing roller rotatably installed in the accommodating cavity;

a photosensitive drum rotatably installed in the cartridge body; and a charging roller that is in contact with a peripheral surface of the photosensitive drum and is spaced from the developing roller, wherein the developing roller is in contact with the peripheral surface of the photosensitive drum; and an absolute value of a charging voltage obtained by the charging roller is greater than an absolute value of a developing bias voltage obtained by the developing roller, and an absolute value of a voltage in an exposed area of the photosensitive drum is less than the absolute value of the developing bias voltage;

the cartridge body is further provided with an opening and a laser channel, the opening communicates with the accommodating cavity, and the opening and the laser channel are oppositely arranged in a width direction of the cartridge body; and the developing roller is located below the charging roller, a laser passing area is formed between the charging roller and the developing roller, and projections of the laser channel, the laser passing area and the photosensitive drum in the width direction of the cartridge body overlap.

14. The process cartridge according to claim 13, wherein the charging voltage, the developing bias voltage, and the voltage of the exposed area are all positive voltages, or the charging voltage, the developing bias voltage, and the voltage of the exposed area are all negative voltages.

15. The process cartridge according to claim 13, wherein the cartridge body is internally further provided with a cleaning member, and the cleaning member is located in the accommodating cavity and installed in the cartridge body, extends in a direction parallel to the charging roller, and is in contact with a peripheral surface of the charging roller.

16. The process cartridge according to claim 15, wherein the cleaning member is made of a conductive material; and an axial end of the charging roller is provided with a charging roller electrode, and both the cleaning member and the charging roller are electrically connected to the charging roller electrode.

17. A process cartridge, comprising:

a cartridge body having an accommodating cavity;

a developing roller rotatably installed in the accommodating cavity;

a photosensitive drum rotatably installed in the cartridge body; and a charging roller that is in contact with a peripheral surface of the photosensitive drum and is spaced from the developing roller, wherein the developing roller is in contact with the peripheral surface of the photosensitive drum; and at a position in which the photosensitive drum is in contact with the charging roller, the charging roller applies a voltage to the photosensitive drum with residual toner; when the photosensitive drum is exposed, an absolute value of a voltage formed in an exposed area is less than an absolute value of a charging voltage, a voltage is applied to the developing roller, an electric field is formed between the developing roller and the photosensitive drum, residual toner in a non-exposed area of the photosensitive drum is transferred from the photosensitive drum to the developing roller, and toner on the developing roller is transferred to the exposed area of the photosensitive drum;

the cartridge body is further provided with an opening and a laser channel, the opening communicates with the accommodating cavity, and the opening and the laser channel are oppositely arranged in a width direction of the cartridge body; and the developing roller is located below the charging roller, a laser passing area is formed between the charging roller and the developing roller, and projections of the laser channel, the laser passing area and the photosensitive drum in the width direction of the cartridge body overlap.

18. The process cartridge according to claim 17, wherein the cartridge body is internally further provided with a cleaning member, and the cleaning member is located in the accommodating cavity and installed in the cartridge body, extends in a direction parallel to the charging roller, and is in contact with a peripheral surface of the charging roller.

* * * * *